United States Patent [19]

Jooris et al.

[11] Patent Number: 4,472,911

[45] Date of Patent: Sep. 25, 1984

[54] CONSTRUCTION FOR ACCESS TO A BURIED PIPELINE

[75] Inventors: Michel Jooris, Gondreville, France; Emile P. Roche, 3, rue Maria Géral, 01000 Bourg en Bresse, France

[73] Assignees: Pont-A-Mousson S.A., Nancy; Emile Pierre Roche, Bourg-en-Bresse, both of France

[21] Appl. No.: 347,209

[22] Filed: Feb. 9, 1982

[30] Foreign Application Priority Data

Feb. 13, 1981 [FR] France ..... 81 02820

[51] Int. Cl.[3] ..... E02D 29/14; E05C 21/02; E21D 1/00

[52] U.S. Cl. ..... 52/20; 49/465; 404/25; 405/133

[58] Field of Search ..... 405/133, 154, 303; 52/20; 404/2, 5, 25, 26; 210/163-165; 49/463, 465

[56] References Cited

U.S. PATENT DOCUMENTS

| | | | |
|---|---|---|---|
| Re. 8,871 | 8/1879 | Graham | 404/25 X |
| 945,597 | 1/1910 | Prendergast | 52/20 |
| 1,712,510 | 5/1929 | Monie | 52/20 |
| 3,530,677 | 9/1970 | Ede | 405/133 |
| 3,745,738 | 7/1973 | Singer | 52/20 X |
| 4,341,236 | 7/1982 | LaBenz | 52/20 X |

FOREIGN PATENT DOCUMENTS

| | | | |
|---|---|---|---|
| 2278852 | 2/1976 | France | 404/25 |
| 2424372 | 12/1979 | France | 52/20 |
| 5905 | of 1888 | United Kingdom | 404/25 |
| 725443 | 3/1955 | United Kingdom | 52/20 |

*Primary Examiner*—Cornelius J. Husar
*Assistant Examiner*—Nancy J. Stodola
*Attorney, Agent, or Firm*—Sughrue, Mion, Zinn, Macpeak & Seas

[57] ABSTRACT

A pipeline 1 crosses a manhole 2 with a degree of clearance and is provided, inside the manhole, with a vertical pipe 19 capped with a removable sealing cover 22. The movement of the pipeline in relation to its surroundings is thus enabled without it being necessary for the manhole to be sealed. The cover is provided with a drainage valve 32 operable from the top of the manhole by a chain 33.

5 Claims, 4 Drawing Figures

CONSTRUCTION FOR ACCESS TO A BURIED PIPELINE

The present invention relates to constructions for access to buried pipelines, of the type comprising an inspection shaft or manhole, whose base is crossed by the pipeline, and an inspection opening proviced in the pipeline inside the shaft.

Buried pipeline systems, and in particular those intended for the sanitation of communities and industrial and agricultural plants, comprise access constructions which are generally placed at a regular distance one from the other, in very varied terrains, including floodable zones. These constructions, known as inspection shafts or manholes, are most often composed of a stack of successive concrete rings whose joints are not always sealed, or by concrete cast on the spot which may have certain related disadvantages. It has recently been noted that to the waters transiting in the system, and in particular at the locations of the inspection shafts, parasitic fluxes have been added uncontrollably due to the collecting of subterranean water, spring water, etc., which unnecessarily burden the purification stations, whose yield then declines rapidly. Conversely, the sanitation systems transport used water and effluents laden with various products, residues of agricultural chemistry and industrial waste, and it is necessary to prevent the contamination of the surrounding terrain or of the phreatic layer.

It was therefore attempted to obtain both sealing of the system from the inside out, so as not to pollute the phreatic layer, in particular with regard to effluents dangerous to the potability of the water, and sealing from the outside in, in order to prevent drainage around the manholes and poor operation of the purification stations, when the system is located beneath the level of the phreatic layer, and yet at the same time allowing inspection and exploitation of the system.

In order to achieve this objective, sealing the concrete manholes may be considered. However, this modification is difficult and expensive on present manufacturing lines, since it, for example, requires modification of the molds on which the rings are produced so as to provide them with joints capable of sustaining a certain pressure.

The object of the invention is to overcome this disadvantage by preventing in a very economical manner any communication between the effluents and the outside surroundings without rendering the shaft watertight.

For this purpose, the object of the invention is a construction for access to a buried pipeline, of the abovementioned type, wherein the opening of the pipeline is provided with a movable sealing cover.

The complete independence thus obtained between the inspection opening and the shaft enables the construction to be produced so that the pipeline traverses the shaft by passing through openings or windows provided at the base of the shaft, the openings being larger than the pipeline to permit play therebetween. In this way unforeseen movements of the shaft, due for example to shifting of the terrain or the road traffic, exerting strain on the pipeline and causing cracks or breakages may be avoided.

In a preferred embodiment, the cover contains an orifice which is normally closed, and is provided with a member for opening the orifice, the member being arranged so that it may be operated from the surface entrance of the shaft.

The invention is described hereafter in greater detail by means of the attached drawings, which represent only two embodiments of the invention. In these drawings.

Figure 1:
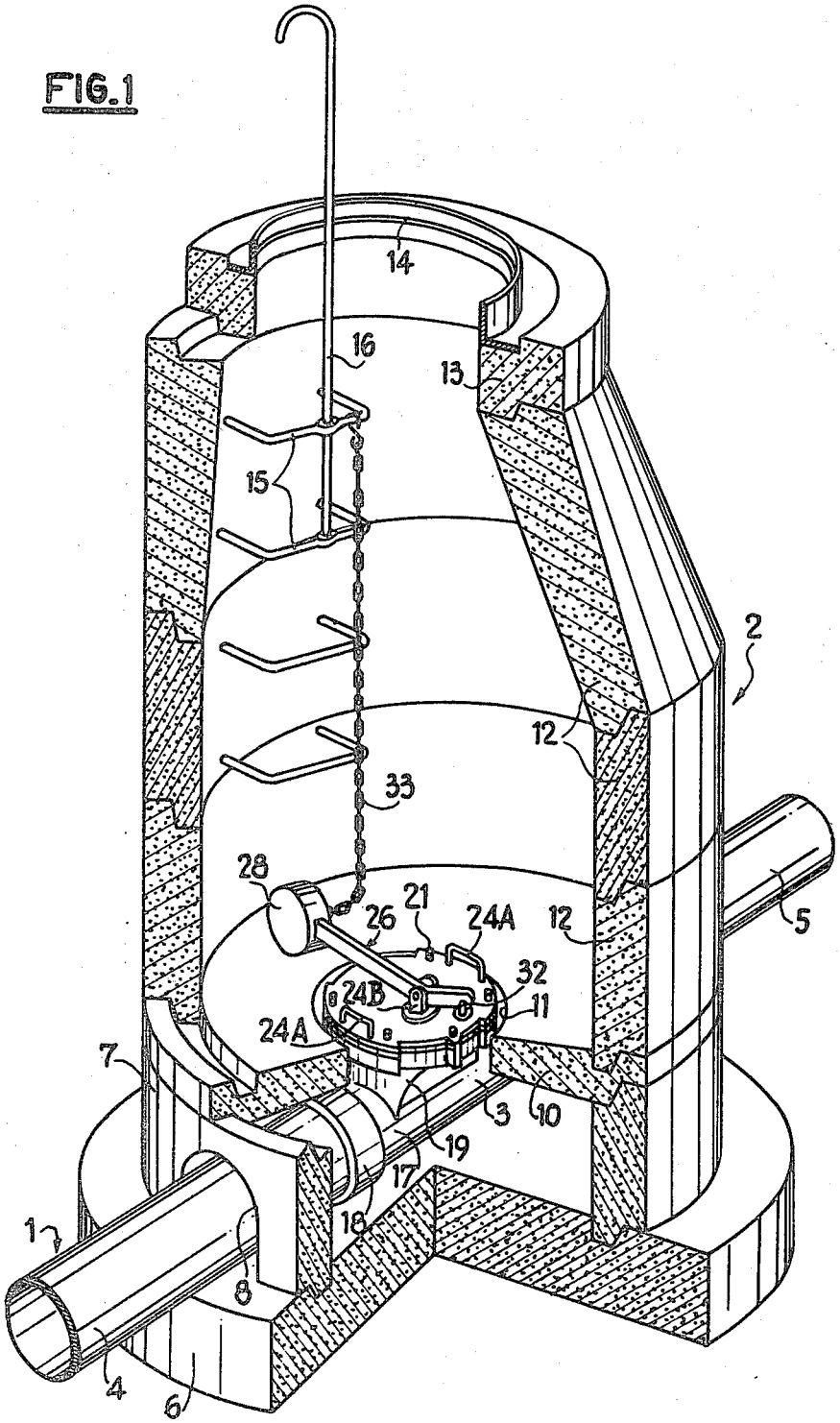
FIG. 1 is a perspective view, in partial cross-section, of a construction in accordance with the invention.
Figure 2:
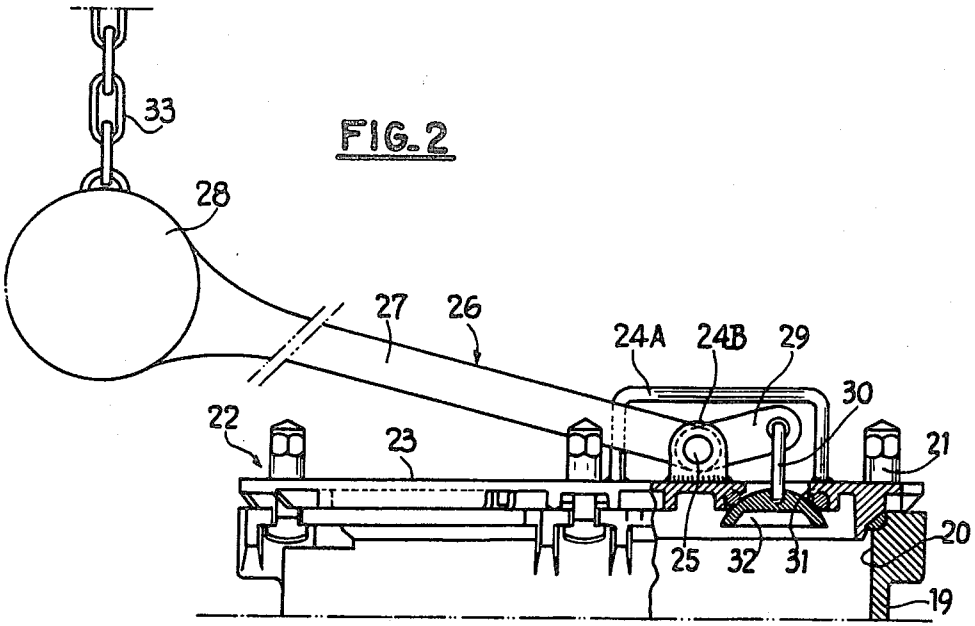
FIG. 2 is an elevated view cross-sectional view illustrating a detail of said construction.
Figure 3:
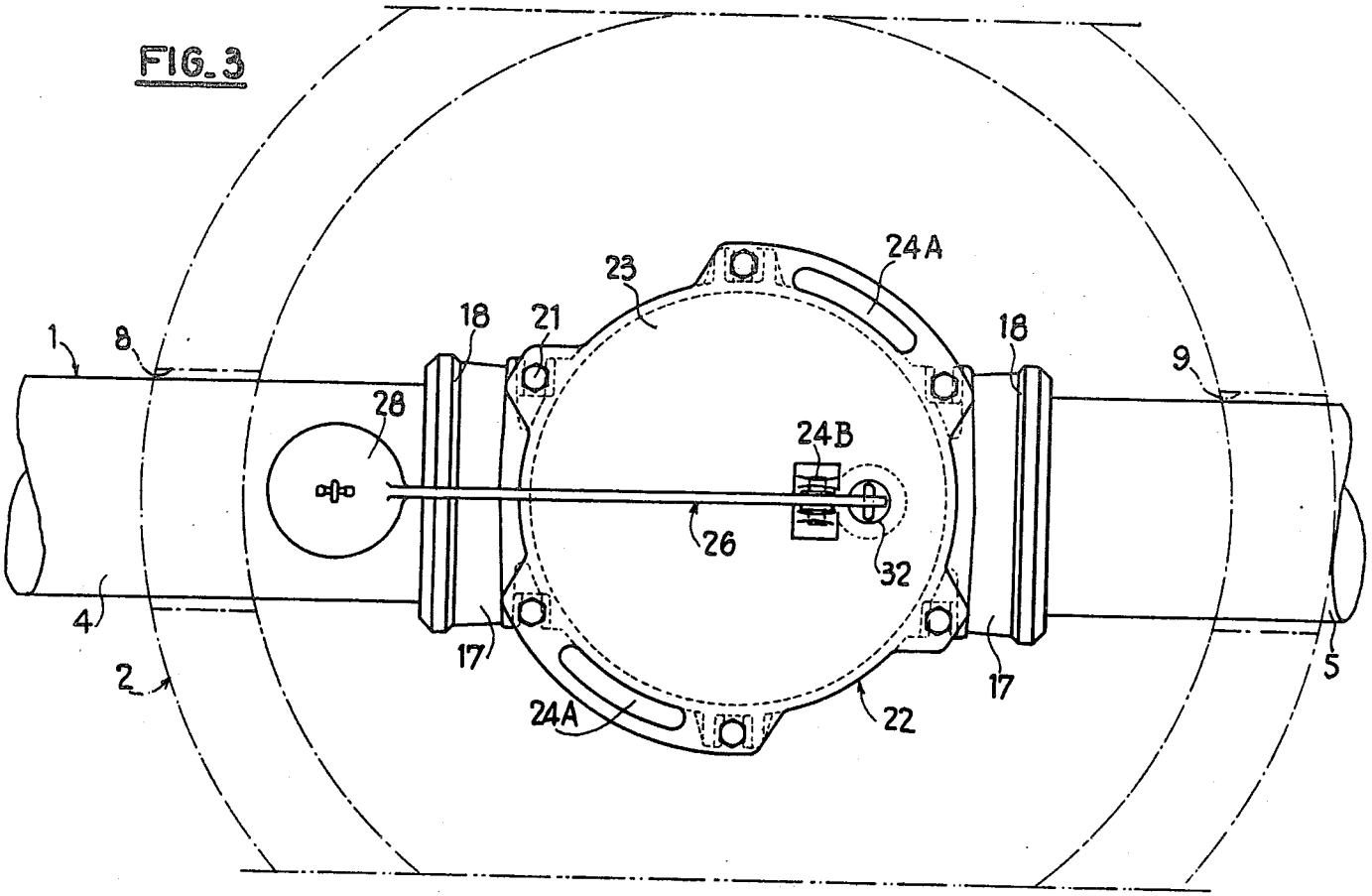
FIG. 3 is a view from above of FIG. 2.

The construction for access to a pipeline 1 of a sanitation system shown in FIGS. 1 to 3 is comprised of a concrete inspection manhole or shaft 2, at the base of which is a T-shaped pipe joint 3 to which two elements or pipes 4, 5 of the pipeline are connected by sealed joints.

The inspection manhole 2 is composed of a base or sole 6 on which rests a circular ring 7 formed with two openings or windows 8, 9 allowing for the passage therethrough, with considerable play, of pipes 4, 5. The ring 7 supports an annular plate 10 forming a floor pierced at its center with a circular opening 11. The plate 10 acts as a base for an assembly of other superposed circular rings 12, which number three in this example, on top of which is a crown 13 on which is sealed a frame 14 for supporting a movable closure plug or manhole cover (not shown) situated at street surface level. The shaft 1 also normally comprises means for access to the bottom such as ladders 15 and a crook 16 sealed in the rings 12.

As shown, the various superposed elements 6, 7, 10, 12, 13 and 14 of the shaft 2 are provided with reciprocal centering reliefs.

The T joint 3 contains two small horizontal pipes 17 connected respectively to pipes 4, 5 by means of couplings 18, and a small pipe or vertical shaft 19 ending in an opening or entry 20 on which a cover or lid 22 is fixed by means of captured peripheral bolts 21. This cover comprises a circular plate 23 from which project handles 24A and a support strap 24B having a horizontal axle 25. The strap can be cast by molding with the plate 23 or can be connected thereto by any appropriate means. The plate 23 is flush with the upper surface of the floor 10 without touching the periphery of the floor opening 11 which surrounds the plate with considerable play or clearance therebetween.

A lever 26 is articulated or pivoted on axle 25 and has one long arm 27 which has a counterweight 28 on its free end. The other short arm 29 of lever 26 is connected at its end, by means of a link 30 which passes through hole 31 of plate 23, to a suspended valve 32 situated under the plate. Under the effect of the counterweight 28, the valve 32 is normally sealably applied against the lower periphery of hole 31, which constitutes the valve seat.

The axle support strap 24B is placed as close as possible to hole 31 so that the lever 26 has two parts with very different lengths forming lever arms, which enables valve 32 to close hole 31 in a sealed manner even when shaft 2 is filled with water. The counterweight 28 can be raised from a distance, in order to open valve 32, by means of chain 33 whose other end can be attached at an upper level of the inspection manhole, for example at the upper ladder rung 15 as shown.

As an alternative, the floor 10 can be replaced with concrete blocks, not shown, cast on both sides and at a distance from the T joint 3 and forming a step, or the floor 10 can be purely and simply left out if the pipeline has a small diameter.

As a further alternative, in order to limit the amount of water penetration through openings 8, 9 of the shaft, these can be closed by flexible screens (not shown) traversed by the pipes 4 and 5. This case often corresponds to the presence of a powerful phreatic layer.

In use, when the personnel responsible for the maintenance of the pipeline 1 have to inspect the pipes, they enter the inspection manhole 2 and, if said manhole does not contain water, they can easily disconnect the cover 22 and then place into the pipelin, by means of the opening 20 of the T joint 3, an inspection camera or a cleaning tool. If, on the other hand, the inspection manhole is overrun with water from the surrounding terrain, they first activate chain 33 to raise the counterweight 28 from a distance, and therefore without risk of contact with doubtful quality water, thereby lowering valve 32 and thus opening orifice 31. The water occupying shaft 2 above the cover 22 is therefore emptied into the pipeline through hole 31. This evacuation of water by gravity can possibly be completed by the action of pumps. When it is completed, the maintenance personnel can, as previously, open cover 22 and then carry out all desired operations. The pumps can be used to efficiently evacuate the water from the manhole during the entire length of these operations; this is not necessary in the case of a powerful phreatic layer but where openings 8, 9 are provided with flexible screens.

A considerable advantage of the invention resides in the suppression of the phenomenon known as "break bending" due to the fact that the inspection manholes, which can be of a weight per unit of bed surface very different from that of the pipeline, cause differential settling of the terrain. By the vertical translation movement which results thereform, traditional manholes, which are directly connected to the pipeline, either overload the pipes, with all the risks of rupture which that involves, or induce angular inflections in the pipelines. In contrast, with the abovedescribed arrangement, to the sanitation system is completely independent from the manhole, and pipes 4, 5 possess a play or freedom of movement in the openings 8, 9 of shaft 2, even if these openings are provided with flexible screens as indicated above. Consequently, the vertical translation of the shaft 2 in relation to the pipeline is not a disadvantage, and vibrations or perturbations caused by rolling loads or movements of terrain are no longer a negative influence.

A further advantage of the invention has been demonstrated during tests for reception under pressure which should be systematically carried out on all new sections of systems: not only is the purge of the air contained in the system rendered possible by valve 32 but also, due to the sealed closing of the T joints 3 by the lids 22, it is possible to test several sections simultaneously.

Moreover, in service, good continuity of the flow in the system is obtained, since the inspection manholes are no longer either obstacles to the flow nor weak points for watertightness, nor obstacles to pressure tests.

Figure 4:
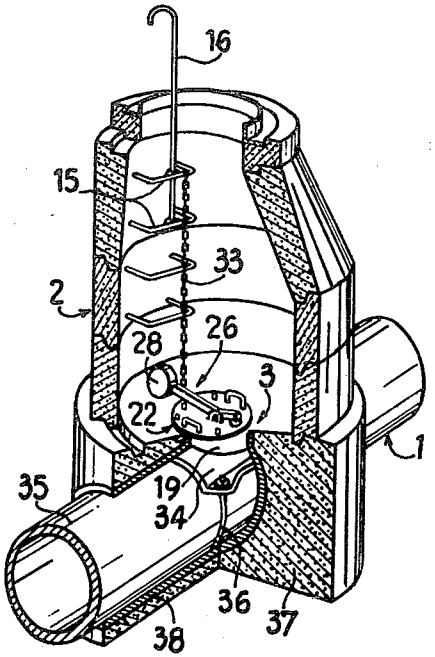
FIG. 4 represents an alternative embodiment of the construction in accordance with the invention.

According to the embodiment shown in FIG. 4, the T joint 3 is only composed of the shaft 19 and a strap or saddle 34 shaped like a portion of a cylinder. The saddle is applied around an opening provided in pipe 35 of the pipeline which crosses the base of the shaft 2 from one side to the other and is connected with a sealed joint to this pipe by means of clamps 36. This alternative provides good adaptation on pipelines in various materials and with larger diameters, for example greater than 400 mm.

In the embodiment of FIG. 4, the base 6, the lower ring 7 and the floor 10 are replaced by a single concrete base 37 with an analogous configuration. After having covered the pipe 35, the saddle 34 and the shaft 19 with a layer 38 of a compressible material such as polystyrene, the base 37 is cast on the spot, and the layer 38 enables the pipeline and the T joint 3 which it supports to have, as previously, a certain clearance or play in relation to the base 37 and therefore to the shaft 2.

In accordance with a further embodiment, which is not shown, the T joint 3, in its forms in FIGS. 1 to 4, or even reduced to the shaft 19 and the cover 22, can be directly soldered to the pipeline 1 when said pipeline is metallic.

The various embodiments of the invention do not exclude the possibility of effecting with the T joint 3 reductions or increases in diameter or to provide in shaft 2 a change in the direction of the pipeline, for example by means of an elbow T joint 3, or even to replace the T joint with two small pipes 17 by a joint comprising three, where two pipes would enter the shaft 2 and one single one would exit therefrom.

As a further alternative, the lid 22 can be rotatably mounted around a fixed axis next to the edge of the opening 20. The opening rotation thus preferably takes place towards the counterweight 28, in which case it is necessary to provide a hollow or groove in the floor 10, if such is present, in order to allow for the passage of this counterweight.

We claim:

1. Construction for providing access to a buried pipeline and comprising:

an inspection manhole having a surface entrance and a buried base portion and having two passage openings in said base portion, the pipeline passing through said openings, the dimensions of said openings being large enough to provide a clearance space between the pipeline and the openings so that there is play between the pipeline and the manhole, whereby there is freedom of movement of the pipeline relative to said manhole;

a portion of the pipeline within said manhole having an inspection opening therein; and openable cover means normally forming a watertight seal with said inspection opening; and wherein said cover means has a drain hole 31 therein, and wherein said construction further comprises:

a valve (32) normally forming a water-tight seal with said drain hole;

valve-operating lever means (26) for opening said valve, said lever means comprising a lever pivotally mounted on said cover means and having one end connected to said valve;

counterweight means mounted on the other end of said lever for keeping said valve in its normally closed, sealing position; and lever operating means extending from said lever to said surface entrance of said manhole for permitting operation of the lever to open said valve and permit liquid in the manhole to drain through said drain hole into said pipeline while said cover means is closed and forming a water-tight seal with said inspection opening.

2. The construction of claim 1 wherein said inspection opening is formed by a T pipe coupling which is inserted in said portion of the pipeline and which has an upstanding shaft, said openable cover means being mounted on said upstanding shaft.

3. The construction of claim 2 wherein said manhole further comprises a floor (10) fixed to said manhole at a level flush with said cover means and having a clearance opening (11) therein surrounding said cover means and said upstanding shaft with clearance thereby permitting play therebetween.

4. The construction of claims 1, 2 or 3 wherein said base portion (37) is solid up to the level of said cover means, and further comprising a layer of compressible material (38) interposed between said base portion and said pipeline, said inspection opening and said cover means, thereby providing freedom of movement between said pipeline and said manhole.

5. The construction of claims 1, 2 or 3 wherein said valve (32) is disposed below said drain hole (31) in said cover means, and wherein said counterweight means acts against the force of gravity normally to force said valve upwardly to close and seal said drain hole.

* * * * *